US006062956A

United States Patent [19]

Elliott

[11] Patent Number: 6,062,956

[45] **Date of Patent: *May 16, 2000**

[54] ROTATABLE BLAST CLEANING CONVEYING SURFACE AND APPARATUS

[75] Inventor: Charles Perry Elliott, Guelph, Canada

[73] Assignee: U.S. Filter/Wheelabrator (Canada) Inc., Oakville, Canada

[ * ] Notice: This patent is subject to a terminal disclaimer.

[21] Appl. No.: 09/185,525

[22] Filed: Nov. 4, 1998

Related U.S. Application Data

[63] Continuation of application No. 08/740,922, Nov. 5, 1996, Pat. No. 5,839,945.

[30] Foreign Application Priority Data

Jul. 4, 1996 [CA] Canada ..... 2180503

[51] Int. Cl.[7] ..... B24C 3/08

[52] U.S. Cl. ..... 451/82; 451/80; 451/89

[58] Field of Search ..... 451/38, 80, 82, 451/84, 88, 89

[56] References Cited

U.S. PATENT DOCUMENTS

| | | | |
|---|---|---|---|
| 919,417 | 4/1909 | Carroll | 451/84 |
| 1,423,128 | 7/1922 | Liedtke | 451/84 |
| 1,713,965 | 5/1929 | Hull | 451/84 |
| 1,883,917 | 10/1932 | Hull | 451/84 |
| 1,887,395 | 11/1932 | Billings et al. | 451/84 |
| 3,270,464 | 9/1966 | Bowling et al. | 451/84 |
| 4,121,387 | 10/1978 | Weis et al. | 451/82 |
| 5,127,198 | 7/1992 | Nakayama et al. | 451/82 |
| 5,417,608 | 5/1995 | Elliott | 451/89 |
| 5,839,945 | 11/1998 | Elliott | 451/82 |

*Primary Examiner*—Eileen P. Morgan
*Attorney, Agent, or Firm*—Riches, McKenzie & Herbert

[57] ABSTRACT

A blast cleaning apparatus is provided having a rotatable conveying surface preferably comprising wire mesh. Workpieces are conveyed through the blast cleaning chamber on the rotating conveying surface such that workpieces may be added to and removed from the conveying surface at a single work station by one operator. Also provided is a method for providing a feed tube to a blast cleaning wheel located below the conveyor, wherein the feed tube is passed through a central hole at the axis of rotation of the conveyor.

6 Claims, 2 Drawing Sheets

ROTATABLE BLAST CLEANING CONVEYING SURFACE AND APPARATUS

This Application is a continuation of application Ser. No. 08/740,922 now U.S. Pat. No. 5,839,945 filed Nov. 5, 1996.

FIELD OF THE INVENTION

The present invention relates to a rotatable blast cleaning conveyor, an apparatus including such a conveyor, and method for blast cleaning various metallic workpieces using the conveyor.

BACKGROUND OF THE INVENTION

Metal workpieces may be cleaned in a blast cleaning apparatus such as that shown and described in U.S. Pat. No. 5,417,608, issued May 23, 1995 to Elliott, and the prior art described therein. The Elliott patent discloses a blast cleaning apparatus wherein a linear wire mesh conveyor, formed as a continuous belt, moves a workpiece in a straight line through a blast cleaning chamber. The wire mesh permits abrasive cleaning material to be directed at the workpiece by blast cleaning wheels located below the conveyor.

In the apparatus of the Elliott patent and similar prior art devices, one operator is required at a first work station upstream of the blast cleaning chamber to place onto the conveyor workpieces to be cleaned, and a second operator is required at a second work station downstream of the blast cleaning chamber to remove from the conveyor workpieces having been cleaned in the blast cleaning chamber.

Clearly, it would be more efficient if a single operator could perform both of these functions, namely placing workpieces to be cleaned onto the conveyor and removing cleaned workpieces from the conveyor. The disadvantage exists that no blast cleaning apparatus is presently known having a conveying surface with openings therethrough, such as a wire mesh conveying surface, in which the workpieces may be added to and removed from the conveyor at one work station by one operator.

Furthermore, conventional segmented conveyors, such as those typically used for conveying baggage at airports, or conveyor systems in which a plurality of linear conveyors meeting at angles of 90 degrees, would not provide satisfactory results in a blast cleaning apparatus due to expense and problems with abrasive cleaning material becoming lodged in such conveyors.

SUMMARY OF THE INVENTION

Accordingly, it is an object of the present invention to overcome the disadvantages of the prior art discussed above.

Therefore, it is one object of the present invention to provide a conveyor for use in a blast cleaning apparatus which has a conveying surface having a plurality of openings, such as a wire mesh, which may be rotated through the blast cleaning chamber so that a workpiece may be placed on and removed from the conveyor at a single work station.

It is another object of the invention to provide a blast cleaning apparatus having a conveyor with a rotatable conveying surface provided with openings, wherein a workpiece may be placed on and removed from the conveyor at a single work station.

It is another object of the present invention to provide a method of blast cleaning a workpiece in a blast cleaning apparatus having a conveyor with a rotating conveying surface wherein a workpiece may be placed on and removed from the conveyor at a single work station.

Accordingly, in one of its broad aspects, the present invention resides in providing a blast cleaning apparatus, comprising: a blast cleaning chamber; a conveying means comprising a conveying surface, said conveying surface being rotatable about a vertical axis into, through and out of the blast cleaning chamber to convey through the blast cleaning chamber a workpiece to be cleaned, said conveying surface having a plurality of openings therethrough, said openings being separated by a separating material; and at least one blast cleaning means oriented to direct abrasive cleaning material at said workpiece while said workpiece is inside said blast cleaning chamber.

Also in another of its broad aspects, the present invention resides in providing a blast cleaning apparatus, comprising: a blast cleaning chamber; a conveying means comprising a conveying surface, said conveying surface being rotatable about a vertical axis into, through and out of the blast cleaning chamber to convey through the cleaning chamber a workpiece to be cleaned, said vertical axis extending through a central hole in said conveying means, said conveying surface having a plurality of openings therethrough, said openings being separated by a separating material; a blast cleaning means located below said conveying surface and oriented to direct abrasive cleaning material upwardly at said workpiece while said workpiece is inside said blast cleaning chamber, said blast cleaning means having an inlet for receiving abrasive cleaning material; supply means located horizontally higher than said conveying surface from which said abrasive cleaning material is supplied to said blast cleaning means; and feed means through which abrasive material is delivered from said supply means to said blast cleaning means, said feed means extending from said supply means to the inlet of said blast cleaning means; wherein said feed means directs abrasive cleaning material through said central hole in said conveying means.

In yet another of its broad aspects, the present invention provides a blast cleaning conveyor, comprising: an outer conveying surface adapted to support a workpiece and convey said workpiece through a blast cleaning chamber of a blast cleaning apparatus, said conveying surface having a plurality of openings therethrough, said openings being separated by a separating material; inner hub means connected to said outer conveying surface; said conveyor being rotatable about a vertical axis passing through said hub means, said vertical axis being perpendicular to said conveying surface.

In yet another of its broad aspects, the present invention provides a method of blast cleaning a workpiece to be cleaned, comprising: conveying said workpiece through a blast cleaning chamber on a horizontal conveying surface, wherein said conveying surface rotates about a vertical axis through said cleaning chamber and has a plurality of openings therethrough, said openings being separated by a separating material; and directing by a directing means abrasive cleaning material upwardly through the openings in said conveying surface so as to clean areas of the workpiece exposed to the cleaning material when the workpiece is in the cleaning chamber.

BRIEF DESCRIPTION OF THE DRAWINGS

Further aspects and advantages of the present invention will become apparent from the following description, taken together with the accompanying drawings in which.

DETAILED DESCRIPTION OF PREFERRED EMBODIMENTS

Preferred embodiments of the present invention are now described with reference to FIGS. 1 and 2.

Figure 1:
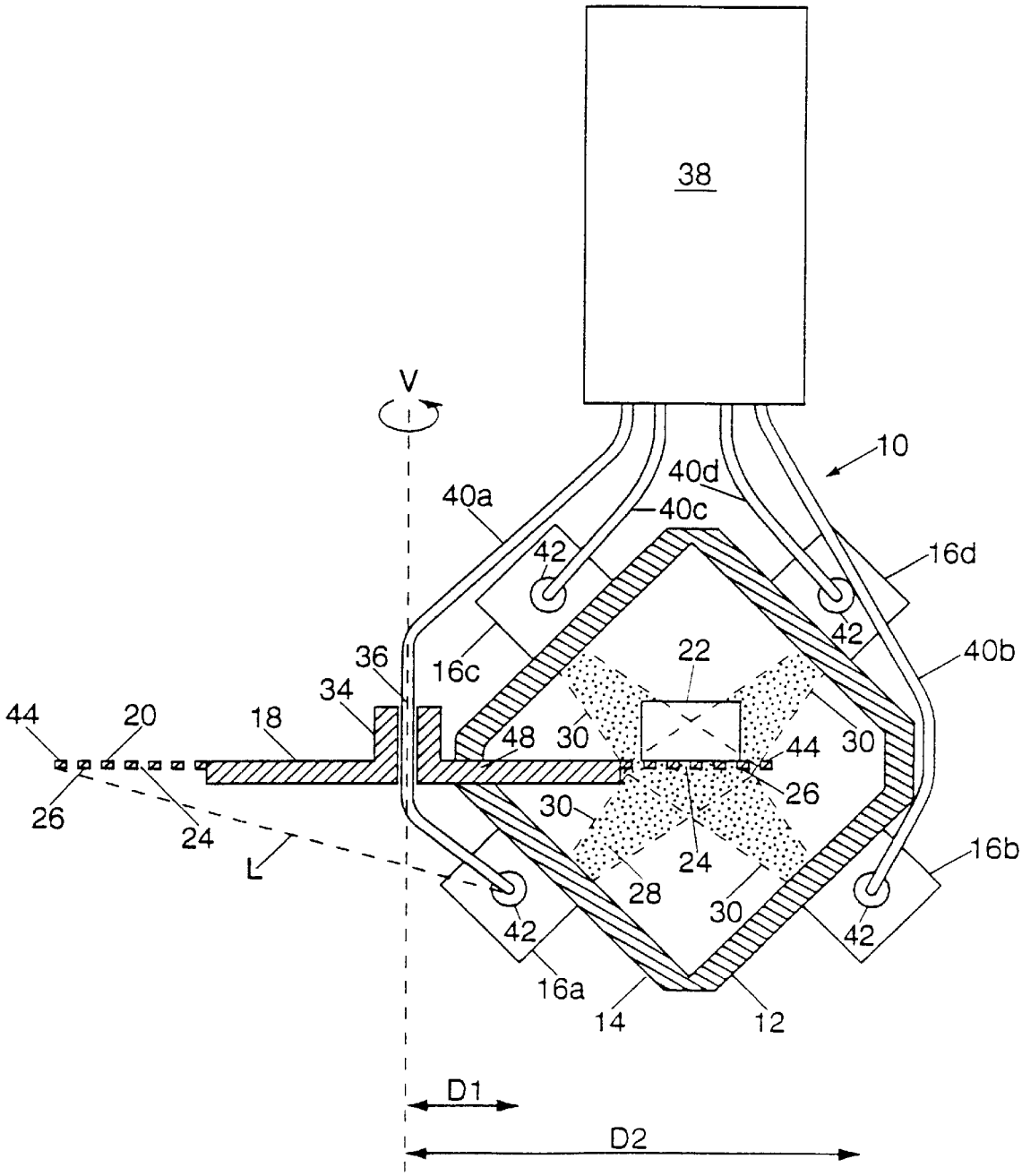
FIG. 1 is a schematic cross-sectional view of a preferred blast cleaning apparatus according to the present invention.

FIG. 1 schematically illustrates a preferred blast cleaning apparatus 10 according to the present invention. The blast cleaning apparatus 10 comprises a blast cleaning chamber 12 having a wall 14, four blast cleaning wheels attached to wall 14, and a conveyor 18 having a conveying surface 20.

The conveying surface 20 is rotatable about vertical axis V and is adapted to support and convey a workpiece 22 in, through and out of the blast cleaning chamber 12. The workpiece 22 may be an automobile part to be reconditioned, a zinc or aluminum die casting, an iron or steel casting, or one of a variety of fabricated metal parts.

The conveying surface 20 is provided with a plurality of openings 24 therethrough, the openings being separated by a separating material 26. One possible conveying surface 20 is a wire mesh such as that disclosed in U.S. Pat. No. 5,417,608 to Elliott, such that separating material 26 comprises wire strands and openings 24 comprise spaces between wire strands. Alternatively, a metal grate may be used. The wire strands or metal grating are preferably comprised of manganese steel, most preferably having a manganese content of about 11 to 13 percent. The openings between wire strands and the grate openings are preferably in the shape of parallelograms having sides of about 2 inches in length. Although a preferred conveying surface 20 comprises wire mesh or metal grating, it is to be appreciated that alternate conveying surfaces 20 having openings 24 and separating material 26 are within the scope of the present invention.

FIG. 1 shows blast cleaning apparatus 10 as having four blast cleaning wheels 16, each oriented to direct abrasive cleaning material 28 at workpiece 22. The abrasive cleaning material 28 preferably comprises pellets which are directed along a pellet stream 30 or blast stream (as shown by dashed lines in FIG. 1). The pellets are typically metallic and preferably have a diameter of from about 0.017 inches to about 0.033 inches.

In order to differentiate between the four blast cleaning wheels 16 shown in FIG. 1, they have been labelled as inner, lower blast cleaning wheel 16*a*; outer, lower blast cleaning wheel 16*b*; inner, upper blast cleaning wheel 16*c* and outer, upper blast cleaning wheel 16*d*. Inner and outer lower blast cleaning wheels 16*a* and 16*b* are located below conveying surface 20 and are oriented to direct abrasive cleaning material 28 upwardly at workpiece 22, through openings 24 in conveying surface 20. Inner and outer upper blast cleaning wheels 16*c* and 16*d* are located above conveying surface 20 and are oriented to direct abrasive cleaning material 28 downwardly at workpiece 22.

It is to be understood that blast cleaning apparatus 10 may have more or less than four blast cleaning wheels 16. The preferred number and location of blast cleaning wheels 16 is at least partially dependent upon the size and shape of the workpiece 22. For example, for workpieces 22 which are relatively low in height, effective cleaning may be accomplished by only one blast cleaning wheel 16 located above conveying surface 20 and one blast cleaning wheel 16 located below conveying surface 20. However, for workpieces 22 of greater height, it is preferred to have at least two blast cleaning wheels 16 located below conveying surface 20 and at least two blast cleaning wheels 16 located above the conveying surface 20. In some instances, it may be preferred to have four blast cleaning wheels 16 below and four blast cleaning wheels 16 above the conveying surface 20.

Figure 2:
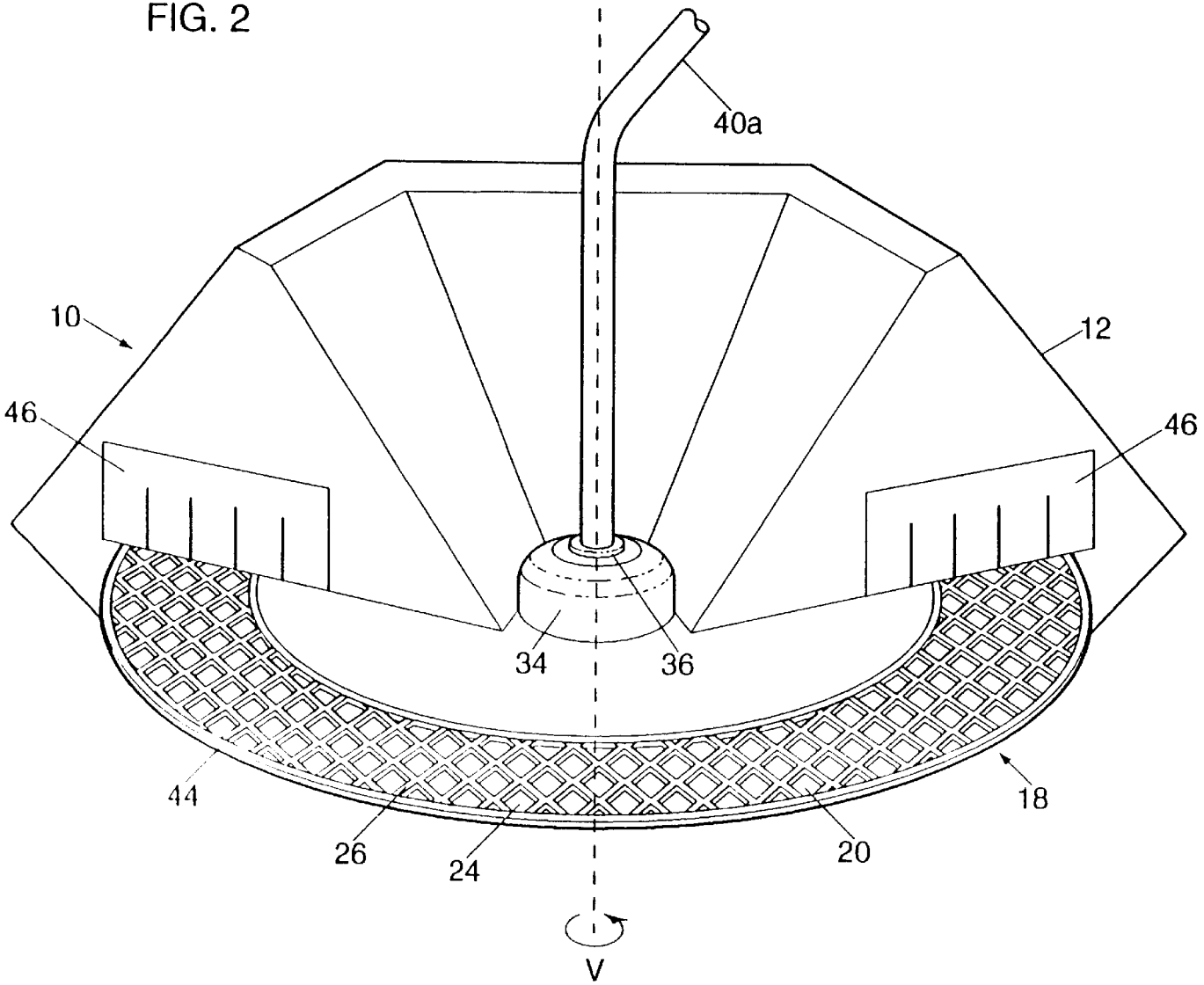
FIG. 2 is a perspective view showing in isolation the blast cleaning chamber and conveyor of the blast cleaning apparatus shown in FIG. 1.

As best shown in FIG. 2, conveyor 18 is preferably circular in shape, having a diameter of from about 6 feet to about 12 feet, and having a continuous conveying surface 20. However, it is to be appreciated that conveyor 18 may be of any convenient shape and size and may have a discontinuous conveying surface 20, as long as conveying surface 20 may be rotated about vertical axis V such that workpieces 22 may be added and removed at a single work station. Other preferred shapes for the conveyor include polygonal shapes, such as square, hexagonal, or octagonal.

In a preferred embodiment of the conveyor 18 shown in FIGS. 1 and 2, the conveying surface 20 is annular, with the conveyor further comprising a hub 34 located in the center of conveyor 18 and centrally of the conveying surface 20. Conveying surface 20 may be of any convenient width, most preferably about 20 inches.

Hub 34 has a central hole 36 coincident with vertical axis V, with the entire conveyor 18, including hub 34, being rotatable about vertical axis V by a conventional driving mechanism (not shown). Although FIGS. 1 and 2 show entire conveyor 18 as being rotatable about axis V, it is to be understood that in some embodiments it may be preferred that only conveying surface 20 is rotatable about axis V.

FIG. 1 also illustrates blast cleaning apparatus 10 as including a receptacle 38 from which abrasive cleaning material 28 is supplied to the blast cleaning wheels 16. The receptacle 38 is preferably located horizontally higher than conveying surface 20 so that abrasive cleaning material 28 may be fed under gravity to each of the blast cleaning wheels 16.

In order to deliver the abrasive cleaning material 28 from the receptacle 38 to blast cleaning wheels 16, feed tubes 40 are preferably provided between receptacle 38 and an inlet 42 on each blast cleaning wheel 16. The feed tubes 40 preferably have a circular cross section and a diameter of about 1½to 3 inches. However, it is to be appreciated that abrasive cleaning material may be fed to blast cleaning wheels by other means, such as tubes or pipes with non-circular cross-sections, or open troughs.

In FIG. 1, feed tubes 40 connecting receptacle 38 to blast cleaning wheels 16*a*, 16*b*, 16*c* and 16*d* are labelled 40*a*, 40*b*, 40*c* and 40*d*, respectively. Each feed tube 40 preferably passes outwardly of blast cleaning chamber 12.

Feed tubes 40 shown in FIG. 1 are inclined at an angle sufficient to allow abrasive cleaning material 28 to flow sufficiently freely therethrough under gravity. This angle is referred to herein as the minimum angle of inclination, and may be defined as an angle of from 0 to 90 degrees formed between a feed tube 40 at any point along the length thereof and a horizontal plane. Although FIG. 1 shows different portions of feed tubes 40 being inclined at different angles, it is to be understood that each portion of each feed tube 40 is inclined at an angle at least equal to or greater than the minimum angle of inclination. In most applications, the minimum angle of inclination is about 45 degrees.

If a feed tube 40 is inclined at an angle substantially less than 45 degrees anywhere along the length thereof, the flow of abrasive cleaning material 28 through feed tube 40 may become too slow or may stop. The angle of inclination may be at least partially dependent on the size of the pellets comprising the abrasive cleaning material 28 and the diameter of feed tube 40.

In the embodiment shown in FIG. 1, inner, lower blast cleaning wheel 16*a* is located directly below conveyor 18, and outer, lower blast cleaning wheel 16*b* is located downwardly and outwardly of the conveyor 18. Specifically, a first radial distance $D_1$ between vertical axis V and the inlet 42 of inner, lower blast cleaning wheel 16*a* is less than a second radial distance $D_2$ between vertical axis V and the inlet 42 of the outer, lower blast cleaning wheel 16*b*.

Because outer, lower blast cleaning wheel 16*b* is located outwardly of conveyor 18, feed tube 40*b* can be simply directed downwardly to inlet 42 of blast cleaning wheel 16*b* outwardly of conveyor 18 and blast cleaning chamber 12, while maintaining an angle of inclination greater than or equal to the minimum angle of inclination throughout its length.

However, inner, lower blast cleaning wheel 16*a* is located directly below conveyor 18, with conveyor 18 forming an obstacle to passage of feed tube 40*a*. If feed tube 40*a* were to pass outwardly of the periphery 44 of conveyor 18, it would not be able to maintain a desired angle of inclination over its entire length. As illustrated by dotted line L in FIG. 1, the portion of feed tube 40*a* between periphery 44 of conveyor 18 and inlet 42 of blast cleaning wheel 16*a* would have an angle of inclination substantially less than the minimum angle of inclination.

The inventor has found that this problem, which does not arise with linear conveyors, may be overcome by passing feed tube 40*a* through the central hole 36 in hub 34. Because the inlet of inner, lower blast cleaning wheel 16*a* is closer to vertical axis V than to periphery 44 of conveyor 18, the angle of inclination of feed tube 40*a* between vertical axis V and inlet 42 of blast cleaning wheel 16*a* is equal to or greater than the minimum angle of inclination. Also, because feed tube 40*a* extends through conveyor 18 at its axis of rotation V, it is unaffected by rotation of conveyor 18.

A preferred method of cleaning a workpiece using the preferred blast cleaning apparatus shown in FIGS. 1 and 2 is now described below.

Firstly, an operator (not shown) places a workpiece 22 onto the conveying surface 20 of conveyor 18 at work station X. The conveyor 18 is rotated about vertical axis V in either a clockwise or counter clockwise direction so that workpiece 22 is conveyed through flap 46 into blast cleaning chamber 12. Once inside chamber 12, rotation of conveyor 18 preferably continues while blast cleaning wheels 16 direct abrasive cleaning material 28 at workpiece 22, thereby cleaning workpiece 22. Rotation of workpiece 22 through blast cleaning chamber 12 continues and workpiece 22 emerges from a second end of blast cleaning chamber 12, through flap 46, having been cleaned. Rotation of conveyor 18 continues until workpiece 22 returns to work station X where it is removed from the conveying surface 20 of conveyor 18 by an operator, preferably the same operator who placed workpiece 22 onto conveyor 18.

It is to be appreciated that more than one workpiece 22 may be placed on conveying surface 20 at any given time, such that the operator at work station X may continuously add and remove workpieces 22 from the conveying surface 20.

As shown in FIG. 2, the blast cleaning chamber 12 preferably has a generally arcuate shape in order to enclose therein a portion of conveying surface 20. Furthermore, wall 14 of blast cleaning chamber 12 is discontinuous in that it has a gap 48 through which conveyor 18 extends into chamber 12. A seal (not shown) is preferably formed in any known manner between conveyor 18 and wall 14 to prevent the escape of substantial amounts of abrasive cleaning material 28 through gap 48.

Although the invention has been described in connection with certain preferred embodiments, it is not intended to be limited thereto. Rather, it is intended that the invention cover all alternate embodiments as may be within the scope of the following claims.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A blast cleaning apparatus, comprising:

a blast cleaning chamber;

a conveying means comprising a conveying surface having an outer periphery, said conveying surface being rotatable about a vertical axis into, through and out of the blast cleaning chamber to convey through the blast cleaning chamber a workpiece to be cleaned, said vertical axis extending through a central hole in said conveying means, said conveying surface having a plurality of openings therethrough, said openings being separated by a separating material;

a blast cleaning means located below said conveying surface and oriented to direct abrasive cleaning material upwardly at said workpiece while said workpiece is inside said ablast cleaning means having an inlet for receiving said abrasive cleaning material;

supply means located above said conveying surface from which said abrasive material is supplied to said blast cleaning means; and feeder through which said abrasive cleaning material is delivered under gravity from said supply means to said blast cleaning means, said feeder delivering abrasive cleaning material from said supply means to the inlet of said blast cleaning means and being inclined at an angle equal to or greater than a minimum angle of inclination required for said abrasive cleaning material to flow freely under gravity through said feeder;

wherein the inlet of the blast cleaning means is positioned such that an angle of inclination of a straight line between said inlet and a point on the periphery of the conveying surface is less than said minimum angle of inclination.

2. The blast cleaning apparatus of claim 1, wherein said minimum angle of inclination is about 45 degrees.

3. The blast cleaning apparatus of claim 1, wherein said feed means is tubular.

4. The blast cleaning apparatus of claim 1, wherein said conveying surface is annular.

5. The blast cleaning apparatus of claim 1, wherein said blast cleaning means comprises a first blast cleaning means and a second blast cleaning means, both of said first and second blast cleaning means being located below said conveying surface and oriented to direct abrasive cleaning material upwardly at said workpiece while said workpiece is inside said blast cleaning chamber, each of said first and second blast cleaning means having an inlet for receiving abrasive cleaning material from said supply means;

a first radial distance between said vertical axis and the inlet of said first blast cleaning means being less than a second radial distance between said vertical axis and the inlet of said second blast cleaning means;

first feeder delivering abrasive material from said supply means to the inlet of said first blast cleaning means, said first feeder directing said abrasive cleaning material from above said conveying means to below said conveying means;

second feeder delivering abrasive material from said supply means or another supply means to the inlet of said second blast cleaning mean, said second feeder directing said abrasive cleaning material outwardly of said conveying surface.

6. The blast cleaning apparatus of claim 5, wherein said first feeder is tubular.

* * * * *